US011479441B2

(12) United States Patent
Kusserow et al.

(10) Patent No.: US 11,479,441 B2
(45) Date of Patent: Oct. 25, 2022

(54) WEIGHTING SENSOR DATA WITH ENVIRONMENTAL DATA IN A SYSTEM FOR TRANSPORTATION OF PASSENGERS

(71) Applicant: Inventio AG, Hergiswil (CH)

(72) Inventors: Martin Kusserow, Lucerne (CH); Reto Tschuppert, Lucerne (CH)

(73) Assignee: INVENTIO AG, Hergiswil (CH)

( * ) Notice: Subject to any disclaimer, the term of this patent is extended or adjusted under 35 U.S.C. 154(b) by 928 days.

(21) Appl. No.: 16/314,885

(22) PCT Filed: Jul. 26, 2017

(86) PCT No.: PCT/EP2017/068890
§ 371 (c)(1),
(2) Date: Jan. 3, 2019

(87) PCT Pub. No.: WO2018/028989
PCT Pub. Date: Feb. 15, 2018

(65) Prior Publication Data

US 2019/0152744 A1 May 23, 2019

(30) Foreign Application Priority Data

Aug. 11, 2016 (EP) ..... 16183820

(51) Int. Cl.
*B66B 5/00* (2006.01)
*B66B 25/00* (2006.01)

(52) U.S. Cl.
CPC ..... *B66B 5/0018* (2013.01); *B66B 5/0006* (2013.01); *B66B 5/0037* (2013.01); *B66B 25/006* (2013.01)

(58) Field of Classification Search
CPC ... B66B 5/0018; B66B 5/0006; B66B 5/0037; B66B 25/006
See application file for complete search history.

(56) References Cited

U.S. PATENT DOCUMENTS

| | | | | |
|---|---|---|---|---|
| 2003/0111306 | A1 | 6/2003 | Watanabe et al. | |
| 2007/0168159 | A1 | 7/2007 | Veronesi et al. | |
| 2008/0283342 | A1 | 11/2008 | Deplazes et al. | |
| 2015/0039136 | A1* | 2/2015 | Gazdzinski | G10L 15/02 700/276 |

(Continued)

FOREIGN PATENT DOCUMENTS

| | | | |
|---|---|---|---|
| CN | 105339290 | A | 2/2016 |
| CN | 205061207 | U | 3/2016 |
| JP | 2007529395 | A | 10/2007 |

(Continued)

*Primary Examiner* — Jeffrey Donels
(74) *Attorney, Agent, or Firm* — William J. Clemens; Shumaker, Loop & Kendrick, LLP

(57) ABSTRACT

A method for determining a state of a system for transportation of passengers includes the steps of: receiving condition data of the system, the condition data being generated by a condition sensor adapted for sensing physical conditions of an equipment of the system; receiving environmental data of the system, the environmental data containing information on an influence of an environment of the system on the equipment and/or the condition sensor; weighting the condition data with the environmental data; and determining a state of the equipment based on the weighted condition data.

13 Claims, 2 Drawing Sheets

(56) References Cited

U.S. PATENT DOCUMENTS

| | | | |
|---|---|---|---|
| 2016/0060076 | A1 | 3/2016 | Schroeder-Brumloop et al. |
| 2018/0290859 | A1* | 10/2018 | Barajas Gonzalez .... G06N 5/04 |

FOREIGN PATENT DOCUMENTS

| | | | |
|---|---|---|---|
| JP | 2009062145 | A | 3/2009 |
| JP | 2009274805 | A | 11/2009 |
| JP | 4443191 | B2 | 3/2010 |
| JP | 2013060295 | A | 4/2013 |
| WO | 03070614 | A2 | 8/2003 |

* cited by examiner

22 CONDITION SENSOR 24 CONDITION DATA
26 ENVIRONMENTAL SENSOR 28 ENVIRONMENTAL DATA
30 CONTROLLER 31 DATA EVALUATOR 33 STATE DETECTOR
32 ENVIRONMENTAL FORECAST DATA

WEIGHTING SENSOR DATA WITH ENVIRONMENTAL DATA IN A SYSTEM FOR TRANSPORTATION OF PASSENGERS

FIELD

The present invention relates to a method, a computer program and a computer-readable medium for determining a state of a system for transportation of passengers. Furthermore, the invention relates to a state determining device and a system for transportation of passengers.

BACKGROUND

Condition sensors for monitoring a status or condition of a system for transportation of passengers may be influenced by the environment. This may lead to spurious sensor readings that have little relation to the technical equipment status being monitored by the sensors. For example, a sound sensor may be influenced by environmental noise, such as passing persons or traffic.

JP 2009 274 805 A relates to an elevator malfunction detecting device, which comprises sound collecting microphones for collecting operating sounds of the equipment of the elevator. The device analyzes characteristics of the collected sounds to detect a malfunction.

US 2003111306 A1 relates to an elevator trouble detection system. To accurately detect a trouble of a magnetic brake by eliminating any effect of a temperature of a location at which the magnetic brake is installed, a first temperature sensor is arranged to measure a temperature of the magnetic brake and a second temperature sensor is arranged to measure a temperature of the air inside the shaft of the elevator. Both temperatures can be defined as condition data of the elevator.

JP 2013060295 A relates to a state determining device for an elevator which prevents an environmental sound such as a vehicle and a human voice which is not caused by the elevator from being detected as an abnormal sound of the elevator caused by the generation of various sounds around the elevator.

There may be a need for increased robustness of data analysis from sensor signals of sensors of a system for transportation of passengers. Furthermore, there may be a need for effective compensation schemes for compensating environmental influences on sensors monitoring data inside a system for transportation of passengers.

SUMMARY

Ideas underlying embodiments of the present invention may be interpreted as being based, inter alia, on the following observations and recognitions.

An aspect of the invention relates to a method for determining a state of a system for transportation of passengers. A system for transportation of passengers may be an elevator, an escalator or a moving walkway. An elevator system may be a system comprising an elevator car, which is moved vertically by a drive in a shaft inside a building, whereby the shaft is also part of the elevator system. An escalator system may be a system with a movable staircase, which also is moved by a drive. A moving walkway may be a system with horizontally movable plates, which also is moved by a drive. For example, the drive may be an electrical motor. All named systems may be adapted for transporting persons.

The system for transportation of passengers comprises mechanical and/or electrical equipment, which is used for providing the functionality of the system for transportation of passengers. For example, the car, the movable staircase, the plates and the drive may be equipment of the respective system. This equipment also may comprise mechanical components as gears, rails, ropes, pulleys, etc. and electrical components such as electrical lines, motors, controllers, actuators, etc.

The state of the system may refer to a state of the respective equipment. The simplest state may only distinguish between working and defect. More sophisticated states may include quantitative values relating to wear, to a predicted future lifetime, to a next service time point, etc. In general, the state of the system may indicate, whether the respective equipment is operating properly or has a malfunction.

According to an embodiment of the invention, the method comprises: receiving condition data of the system, the condition data being generated by a condition sensor adapted for sensing physical conditions of an equipment of the system; receiving environmental data of the system, the environmental data containing information on an influence of an environment of the system on the equipment and/or the condition sensor; weighting the condition data with the environmental data; and determining a state of the equipment based on the weighted condition data.

In general, the state of a system and/or equipment may be determined from condition data of the equipment. This condition data may be data generated by a condition sensor situated in, on or near the equipment, which state has to be monitored. A condition sensor may be or may comprise at least one of a microphone, vibration sensor, acceleration sensor, pressure sensor, temperature sensor, current sensor, etc. The physical conditions of the equipment may be a measurable quantity provided or emanated by the equipment, such as sound, vibrations, accelerations, pressure, temperature, current, voltage, etc. related to the respective equipment. The condition data may be analog or digital data encoding the physical condition.

For example, the sound (in general the physical conditions) produced by a pulley, a wheel on a rail, a motor, a gear may change and/or may increase, when the respective equipment is subjected to wear. In this case, the frequency or the sound pressure may be encoded in condition data for the respective equipment, which condition data may be recorded with a microphone placed in, on or near the respective equipment.

It may be that the condition data is unintentionally influenced by the environment of the elevator and/or escalator system. For example, it may be that a microphone is also recording sound not produced by the equipment itself but by passing persons, traffic, by rain, thunder, etc. In this case, the condition data may not be any more a good indicator for the state of the equipment.

With environmental data, environmental influences on equipment may be compensated. Environmental data may encode physical conditions of the environment, which also may be sensed by the condition sensor. For example, environmental data may encode sound produced by persons or traffic passing the system. Environmental data need not be sensor data. If environmental data is measured by a sensor, the sensor is located outside of the system for transportation of passengers, for example outside of an elevator system. So, the named sensor isn't located inside a shaft or a machine room of the elevator. Environmental data also may encode weather conditions at the site of the system, from which, for example, it may be deduced that there is a thunderstorm or it is raining, when the condition data is produced. Another example with a more abstract type of environmental data are time intervals, when traffic is passing the system (such as a train schedule).

With the environmental data, the condition data may be weighted. Weighted condition data not only may comprise information on the physical conditions of the equipment but also on the physical conditions of the environment. With this additional information, it may be possible to determine more correctly the state and therefrom a maintenance need of the equipment.

According to an embodiment of the invention, the environmental data comprises sensor data generated by an environmental sensor adapted for sensing physical conditions of an environment of the system. It may be possible that the environmental data is generated with a further sensor, which may be called environmental sensor or compensation sensor. This further sensor may be of the same type as the condition sensor, but may be situated at a different place as the condition sensor. For example, the environmental sensor may be placed remote from the condition sensor, for example outside of the building, in which the system is installed. In general, an environmental sensor may be or may comprise at least one of a microphone, vibration sensor, acceleration sensor, pressure sensor, temperature sensor, current sensor, etc.

As an example, one or more microphones inside the building, for example inside the elevator shaft, may serve as input to condition monitoring of an elevator. One or more microphones outside the elevator system may monitor environmental sounds, e.g., traffic noise, construction works, or the weather such as strong wind or thunderstorms. The environmental data from the microphones outside of the elevator may be used to compensate an influence of environmental sounds for the condition monitoring microphones.

According to an embodiment of the invention, the environmental sensor is placed, such that it is adapted to acquire the physical conditions of the environment stronger than the physical conditions of the equipment. It may be that the environmental sensor is placed, such that it is not able to acquire physical conditions of the respective equipment. However, it also may be possible that it senses the physical conditions of the equipment and the environment, but with another relationship as the condition sensor. It may be that the environmental sensor is a condition sensor of another equipment. The environmental data may be determined by subtracting the condition data from the sensor data of the environmental sensor.

According to an embodiment of the invention, the environmental data provided by the environmental sensor is transmitted via the Internet to a sensor data evaluator weighting the condition data. It may be that the environmental sensor is not directly part of the system for transportation of passengers. Sensors of other systems, such as building automation systems, may be used as environmental sensors. For example, data from a temperature and/or wind sensor on a roof of the building, in which the elevator and/or escalator system is situated, may be used as environmental sensor. These sensors may be connected via the Internet with the device evaluating the condition data.

The environmental sensor may be either directly connected (electrical connection to the environmental sensors) or indirectly connected (via the Internet) to the device evaluating the sensor data and performing the method.

The environmental sensor also may be provided by a smartphone or other mobile device that may be temporary at the site of the elevator and/or escalator system. For example, the environmental sensors may include sensors in mobile phones of people in the proximity of the elevator and/or escalator system that upload their measurements to a web service or to a cloud data storage.

According to an embodiment of the invention, the environmental data comprises forecast data generated by an environmental data provider, and the method may comprise determining physical conditions of an environment of the system based on the forecast data. Forecast data may be predicted data that is not measured but determined for the future. For example, the forecast data comprises at least one of: weather forecast data, traffic information data, traffic schedule data, public holiday data.

There are several possibilities, how the condition data is weighted with the environmental data.

According to an embodiment of the invention, the condition data is weighted, such that condition data is discarded, when the environment data indicates an influence of the environment on the condition data higher than a threshold. In a simple case, only condition data is further processed, when there is no or nearly no influence of the environmental data on the condition data. For example, the condition data only may be used, when the environmental data from an environmental sensor indicates that the physical conditions of the environment are within specific bounds. For example, the environmental noise is smaller than a threshold or the environmental temperature is within temperature bounds.

According to an embodiment of the invention, the condition data is weighted, such that condition data is provided with a weight value indicative of an influence of the environment on the condition data. The weight value may be a number between 0 and 1, wherein 0 indicates that the condition data is completely based on environmental physical conditions and 1 indicates that the condition data is completely based on equipment physical data. The weight value may be based on a correlation between the condition data and the environmental data.

In general, different models may be used to compensate environmental influences, for example, skipping of condition data, when a correlation between environmental sensors and condition sensors is too high, decreasing the importance of condition data using weighted updates, adaptive filtering, etc.

According to an embodiment of the invention, the condition data is weighted and the state of the equipment is determined by a controller of the elevator and/or escalator system. For example, the method may be performed by a device that is placed inside the building, in which the elevator and/or escalator system is situated.

According to an embodiment of the invention, the condition data is weighted and the state of the equipment is determined by a server connected via the Internet with the condition sensor. The method may be performed by a cloud application, for example in a data processing center or cloud computing facility.

A further aspect of the invention relates to a computer program, which, when executed on at least one processor, is adapted for performing the method according to one of the preceding embodiments. For example, the computer program may be performed by a controller of the system, which is also used for controlling further functionality of the system, such as controlling the drive. However, it also may be possible that the computer program is executed in a server remote from the system, which server receives the condition data and the environmental data via the Internet.

A further aspect of the invention relates to a computer-readable medium, in which such a computer program is stored. A computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. In general, the computer-readable medium may be a non-transitory or transitory medium. For example, the computer program may be stored in a memory of a controller of the system or in a server remote from the system.

A further aspect of the invention relates to a state determining device for a system for transportation of passengers. The state determining device may be a controller of the system or may be a server remote from the system.

According to an embodiment of the invention, the state determining device comprises a sensor data evaluator and a state detector. Both the sensor data evaluator and the state detector may be software modules. The sensor data evaluator may be adapted: for receiving condition data of the system, the condition data being generated by a condition sensor adapted for sensing physical conditions of an equipment of the system; for receiving environmental data of the system, the environmental data containing information on an influence of an environment of the system on the equipment and/or the condition sensor; and for weighting the condition data with the environmental data. The state detector may be adapted for determining a state of the equipment based on the weighted condition data.

A further aspect of the invention relates to a system for transportation of passengers comprising a state determining device. As already mentioned, the system may comprise a controller providing the state determining device.

It has to be understood that features of the method as described in the above and in the following may be features of the computer program, computer-readable medium, state determining device and system for transportation of passengers, as described in the above and in the following, and vice versa.

In the following, advantageous embodiments of the invention will be described with reference to the enclosed drawings. However, neither the drawings nor the description shall be interpreted as limiting the invention.

The figures are only schematic and not to scale. Same reference signs refer to same or similar features.

DETAILED DESCRIPTION

Figure 1:
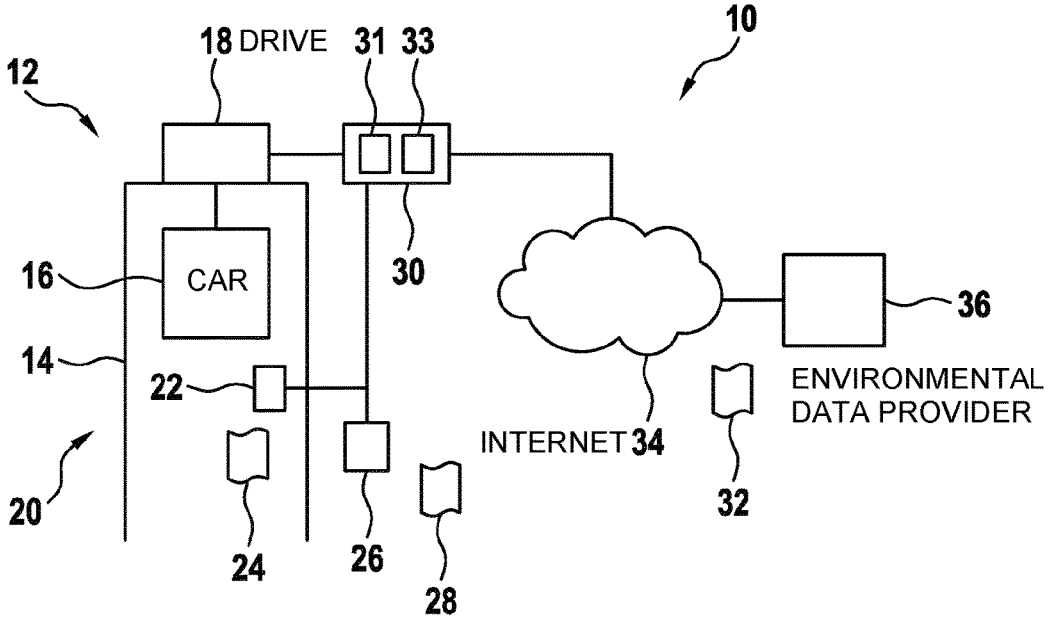
FIG. 1 schematically shows a system for transportation of passengers in form of an elevator system according to an embodiment of the invention.

FIG. 1 shows an elevator system 10 comprising an elevator 12, which may have a car 16 that may be moved vertically in an elevator shaft 14 by a drive 18. The elevator system comprises several mechanical and/or electrical equipment 20, such as the drive 18, the car 16, a rope, doors, rails, etc.

The elevator system 10 comprises one or more condition sensors 22, which, for example, are situated in the elevator shaft 14. In general, a condition sensor 22 is placed, such that it is adapted for monitoring a physical condition of the equipment 20 of the elevator system 10, such as a temperature, vibrations, sounds, currents, etc. The condition sensor 22 generates condition data 24 of the equipment 20, which indicates the current physical condition of the equipment 20.

Furthermore, the elevator system 10 comprises one or more environmental sensors 26, which, for example, may be placed outside of the elevator shaft 14. An environmental sensor 26 may be placed, such that it is adapted for monitoring environmental conditions of the environment of the elevator system 10. The environmental sensor 26 may be part of the system 10, for example for sensing physical conditions of another equipment of the system 10. Alternatively, the environmental sensor 26 may be an external sensor, for example of a building automation system. The environmental sensor 26 generates environmental sensor data 28 of the elevator system 10.

The condition data 24 of the equipment 20 and/or the environmental data may be sent via an electrical bus or otherwise to a controller 30 of the elevator system 10 and/or may be collected by the controller 30. For example, the controller 30 may be adapted for controlling the drive 18 and/or other equipment 20 of the elevator system 10. The controller 30 comprises a sensor data evaluator 31, which receives the condition data 24 and the environmental data 28 and weights the condition data 24 with the environmental data 28. In a simple case, the condition data is discarded, when the environmental data indicates a high influence of the environment on the condition data 24.

The controller 30 furthermore comprises a state detector 33, which receives the weighted condition data 24, and which determines a state of the equipment 20 based on the weighted condition data 24. The state of the equipment 20 may indicate, whether the equipment is operating properly or has a malfunction and/or may indicate a wear of the equipment. For example, a maintenance of the equipment 20 may be triggered, when a wear is higher than a threshold or when a malfunction is detected.

Additionally, the controller 30 also may receive environmental forecast data 32 via the Internet 34. The forecast data 32 may be provided by an environmental data provider 36, which, for example, may be a weather data provider or a provider of traffic data. Alternatively or additionally, the environmental forecast data 32 may be used for weighting the condition data 24.

Figure 2:
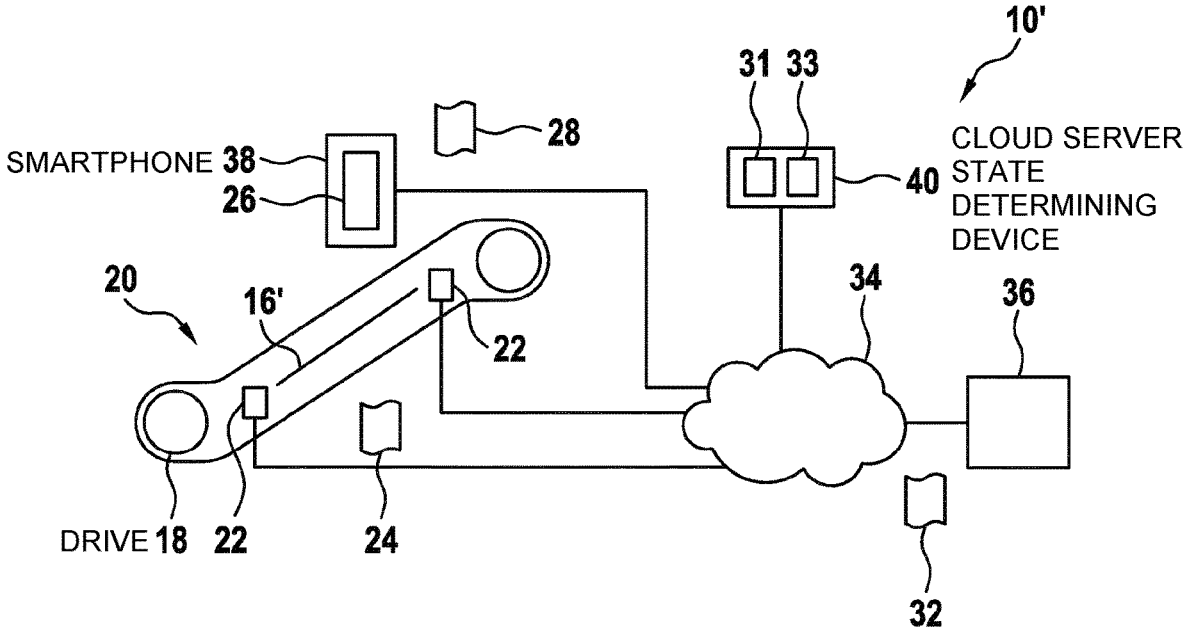
FIG. 2 schematically shows a system for transportation of passengers in form of an escalator system according to an embodiment of the invention.

FIG. 2 shows an escalator system 10', which comprises a movable staircase 16' that is driven by a drive 18. The escalator system 10' comprises equipment 20, which may include the drive 18, the movable stairs, handrails, etc. As the system of FIG. 1, the escalator system 10' may comprise condition sensors 22 and optionally environmental sensors 26. In the example of FIG. 2, an environmental sensor 26 is provided by a smartphone 38, which may be carried by a person using the escalator system 10'. When the smartphone 38 comes in the vicinity of the escalator system 10', it may start to acquire environmental data 28 that may be sent to a sensor data evaluator 31, for example via the Internet 34. Also the system of FIG. 1 may receive environmental data 28 in such a way.

The system 10' comprises a state determining device in the form of a cloud server 40. The sensor data evaluator 31 and the state detector 33 may be computer programs executed in the cloud server 40. However, it also may be possible that it comprises a state determining device in the form of a controller 30 as the system 10 of FIG. 1. The condition data 24 and the environmental data 28, 32 may be received via the Internet 34. Additionally, it may be possible that the system 10 of FIG. 1 comprises a state determining device in the form of a cloud server 40 of FIG. 2.

Figure 3:
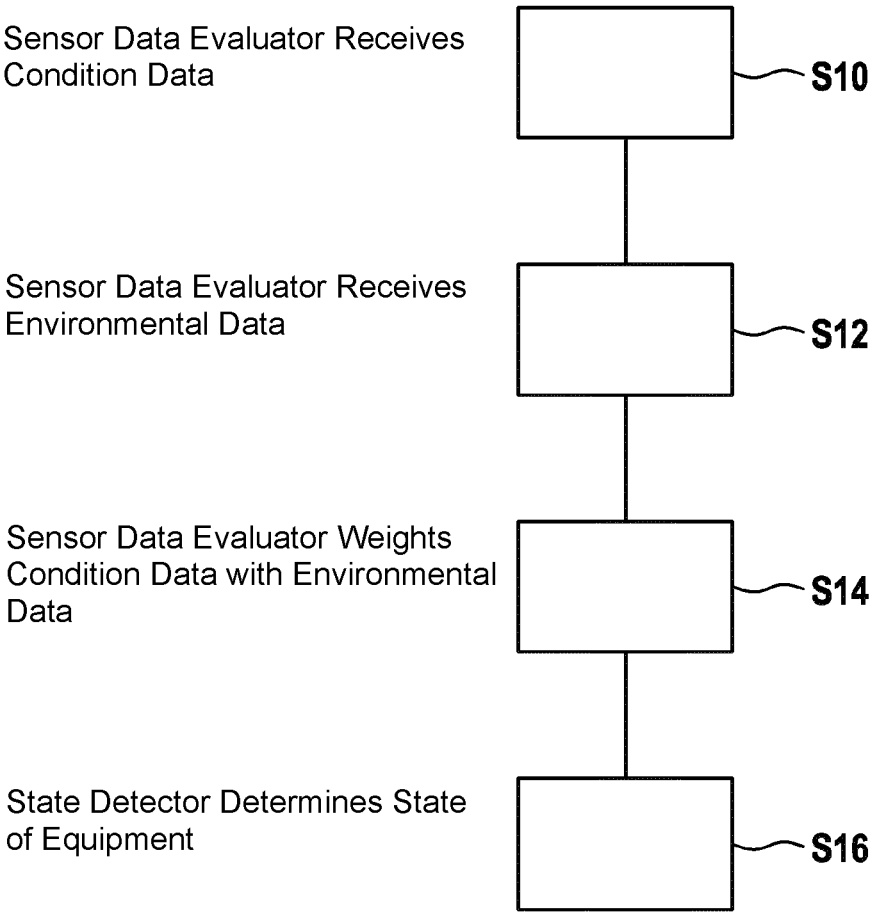
FIG. 3 shows a flow diagram for a method for determining a state of a system for transportation of passengers according to an embodiment of the invention.

FIG. 3 shows a method that may be performed by a state determining device, for example the controller 30 or the cloud server 40. In the following, the method will be explained with respect to sound as physical condition, i.e. the condition sensor 22 and the environmental sensor 26 may be microphones. However, the method may be applicable to any kind of physical condition, such as temperature, pressure, vibration, current, voltage, etc.

In step S10, the sensor data evaluator 31 receives condition data 24 of an equipment 20 of the system 10, 10', the condition data 24 being generated by a condition sensor 22 adapted for sensing physical conditions of the equipment 20. For example, a sound sensor or microphone 22, which is placed near the equipment, may record sound emanations of the equipment 20, which may be a mechanical equipment, which may produce different sound, when it has a malfunction or when it is worn.

However, the condition sensor 22 may not only sense the physical condition of the equipment 20 (i.e. the sound of the equipment 20) but also physical conditions of the environment (i.e. sound from the environment). For example, persons passing the system, rain, traffic, thunder, etc. may generate additional sound that is also recorded by the microphone 22 near the equipment.

The condition data 24 in the form of digitized sound signals may be sent to the sensor data evaluator 31 i.e. via the Internet or a bus communication.

In step S12, the sensor data evaluator 31 receives environmental data 28, 32 of the system 10, 10', the environmental data 28, 32 containing information on an influence of an environment of the system on the equipment 20 and/or the condition sensor 22. The environmental data may contain environmental sensor data 28 or environmental forecast data 32, which both may be used for determining, whether the environment has influenced the condition data more or less.

Environmental sensor data 28 may be generated by an environmental sensor 26 adapted for sensing physical conditions of the environment of the system 10, 10'. The environmental sensor 26 may be placed, such that it is adapted to acquire the physical conditions of the environment stronger than the physical conditions of the equipment 20.

For example, the environmental sensor 26 may be placed outside of the building, in which the system 10, 10' is situated or at least outside of a room or space, in which the system 10, 10' is situated. The environmental sensor 26 may be of the same type as the condition sensor 22. In the case of sound as physical condition, the environmental sensor 26 may be a microphone that is placed more remote to the equipment 20 than the condition sensor 22. This microphone then may record sound that is generated by the environment of the system 10, 10'. As the condition data 24, the environmental sensor data 28 may be sent to the sensor data evaluator 31 via the Internet 34.

It also may be possible that the environmental sensor 26 is not a part of the system 10, 10' but is provided by another system, such as a building automation system or by a smartphone or other mobile devices.

Alternatively or in combination with the environmental sensor data 28, the sensor data evaluator 31 may receive environmental forecast data 32, which may be generated by an environmental data provider 36. For example, the environmental forecast data 32 may comprise weather data, traffic data, trains schedules, etc.

The sensor data evaluator 31 may determine physical conditions of an environment of the system 10, 10' based on the forecast data 32. For example, the sensor data evaluator 31 may determine from weather data that during a specific time interval, there was rain in the vicinity of the system 10, 10', which caused environmental sound. It also may be possible that the sensor data evaluator 31 determines that a train passed in the vicinity of the system 10, 10' causing environmental sound.

In step S14, the sensor data evaluator 31 weights the condition data 24 with the environmental data 28, 32. In a simple case, the condition data 24 is weighted, such that the condition data 24 is discarded, when the environment data 28, 32 indicates an influence of the environment on the condition data higher than a threshold. For example, the condition data 24 is discarded, when the environmental sound indicated by the environmental sensor data 32 is higher than a threshold. Also, the condition data 24 may be discarded, when it has been determined that it rained or that there was a thunderstorm during the recording of the condition data 24.

In another possibility, the condition data 24 is weighted, such that condition data 24 is provided with a weight value indicative of an influence of the environment on the condition data 24. For example, the condition data 24 may be weighted with the sound intensity of the environmental sound recorded by a microphone as environmental sensor 26. When there is no environmental sound, then the condition data 24 may have a high weight value, indicating that the condition data 24 is reliable. When there is high environmental sound, the weight value may be low or zero, indicating that the condition data is not very reliable.

In step S16, the state detector 33 determines a state of the equipment 20 based on the weighted condition data 24. For example, the state detector may compare the condition data 24 with older and/or with standard condition data. A deviation of the actual condition data 24 from the older/standard condition data may be a measure for a wear or a malfunction of the equipment. For example, when the sound (in a specific frequency range) produced by an equipment 20 is higher than a threshold, then a malfunction of the equipment may be assumed.

Here, the weight value may be used for determining the state. For example, only condition data with a weight value higher than a threshold may be used. Also the weight value may enter statistical evaluations of the condition data 24.

Finally, it should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for determining a state of a system for transportation of passengers, the method comprising the steps of:

receiving condition data of the system, the condition data being generated by a condition sensor adapted for sensing physical conditions of an equipment of the system;

receiving environmental data of the system, the environmental data containing information on an influence of an environment of the system on at least one of the equipment and the condition sensor;

weighting the condition data with the environmental data;

determining a state of the equipment based on the weighted condition data;

wherein the environmental data comprises sensor data generated by an environmental sensor adapted for sensing physical conditions of the environment of the system;

wherein the environmental sensor is located outside of the system; and wherein the condition data is weighted and the state of the equipment is determined by a controller of the system, the system being at least one of an elevator system and an escalator system.

2. The method according to claim 1 wherein the environmental data provided by the environmental sensor is transmitted via an Internet connection to a sensor data evaluator for the weighting the condition data.

3. The method according to claim 1 wherein the condition sensor is at least one of a microphone, a vibration sensor, an acceleration sensor, a pressure sensor, a temperature sensor and a current sensor.

4. The method according to claim 1 wherein an environmental sensor is at least one of a microphone, a vibration sensor, an acceleration sensor, a pressure sensor, a temperature sensor and a current sensor.

5. The method according to claim 1 wherein the environmental data is forecast data generated by an environmental data provider, and including a step of determining the physical conditions of the environment of the system based on the forecast data.

6. The method according to claim 5 wherein the forecast data includes at least one of weather forecast data, traffic information data, traffic schedule data and public holiday data.

7. The method according to claim 1 wherein the condition data is weighted, such that condition data is discarded, when the environment data indicates an influence of the environment on the condition data higher than a predetermined threshold.

8. The method according to claim 1 wherein the condition data is weighted, such that condition data is provided with a weight value indicative of the influence of the environment on the condition data.

9. The method according to claim 1 wherein the condition data is weighted and the state of the equipment is determined by a server connected via an Internet connection with the condition sensor.

10. A computer program product comprising a computer program stored on a non-transitory computer-readable medium, which, when executed on at least one processor, performs the method according to claim 1.

11. The computer program product according to claim 10 including a non-transitory computer-readable medium in which the computer program is stored.

12. A state determining device for a system for transportation of passengers, the state determining device comprising:

a sensor data evaluator adapted for receiving condition data of the system, the condition data being generated by a condition sensor adapted for sensing physical conditions of an equipment of the system;

the sensor data evaluator being adapted for receiving environmental data of the system, the environmental data containing information on an influence of an environment of the system on at least one of the equipment and the condition sensor, the sensor data evaluator weighting the condition data with the environmental data;

a state detector adapted for determining a state of the equipment based on the weighted condition data;

wherein the environmental data includes sensor data generated by an environmental sensor adapted for sensing physical conditions of the environment of the system; and wherein the environmental sensor is located outside of the system.

13. A system for transportation of passengers including the state determining device according to claim 12.

* * * * *